US008919065B2

(12) United States Patent
Bradford

(10) Patent No.: US 8,919,065 B2
(45) Date of Patent: Dec. 30, 2014

(54) EXPANSION JOINT SYSTEM USING FLEXIBLE MOMENT CONNECTION AND FRICTION SPRINGS

(75) Inventor: Paul Bradford, West Falls, NY (US)

(73) Assignee: Construction Research & Technology GmbH, Trostberg (DE)

( * ) Notice: Subject to any disclaimer, the term of this patent is extended or adjusted under 35 U.S.C. 154(b) by 148 days.

(21) Appl. No.: 12/781,063

(22) Filed: May 17, 2010

(65) Prior Publication Data

US 2010/0281807 A1 Nov. 11, 2010

(51) Int. Cl.
*E04B 1/682* (2006.01)
*E01D 19/06* (2006.01)

(52) U.S. Cl.
CPC ..... *E01D 19/062* (2013.01)
USPC ..... 52/396.02; 52/396.04; 52/396.05; 404/56

(58) Field of Classification Search
CPC ..... E04B 1/681; E04B 1/6807
USPC ..... 52/393, 395, 396.02, 396.03, 396.04, 52/396.05, 396.06, 573.1; 14/73.5; 404/56
See application file for complete search history.

(56) References Cited

U.S. PATENT DOCUMENTS

| | | | | | |
|---|---|---|---|---|---|
| 3,113,493 | A | * | 12/1963 | Rinker | 404/47 |
| 3,183,626 | A | * | 5/1965 | Schmitt | 52/395 |
| 3,344,720 | A | * | 10/1967 | Hallock | 404/47 |
| 3,371,456 | A | * | 3/1968 | Balzer et al. | 52/278 |
| 3,390,501 | A | * | 7/1968 | Driggers | 52/395 |
| 3,394,639 | A | * | 7/1968 | Viehmann | 404/47 |
| 3,482,492 | A | * | 12/1969 | Bowman | 404/56 |
| 3,907,443 | A | | 9/1975 | McLean | |
| 4,132,491 | A | | 1/1979 | Scheffel | |
| 4,271,650 | A | * | 6/1981 | Lynn-Jones | 52/395 |
| 4,516,284 | A | * | 5/1985 | Huber et al. | 14/73.1 |
| 4,914,884 | A | * | 4/1990 | Ohmatsu | 52/396.05 |
| 5,302,050 | A | * | 4/1994 | Buckenauer et al. | 404/53 |

(Continued)

FOREIGN PATENT DOCUMENTS

| | | | | |
|---|---|---|---|---|
| CN | 201258459 | | 6/2009 | |
| EP | 0215980 | A1 | 4/1987 | |
| EP | 0338124 | A2 | 10/1989 | |
| JP | 02125044 | A * | 5/1990 | E04B 1/62 |

OTHER PUBLICATIONS

PCT/EP2011/057513—International Search Report, Nov. 2, 2011.

(Continued)

*Primary Examiner* — Jeanette E Chapman
*Assistant Examiner* — James Buckle, Jr.
(74) *Attorney, Agent, or Firm* — Curatolo Sidoti Co., LPA; Joseph G. Curatolo; Salvatore A. Sidoti

(57) ABSTRACT

An expansion joint system for bridging a gap that is located between spaced-apart structural members. The expansion joint system may be utilized, for example, in roadway, bridge and tunnel constructions where gaps are formed between spaced-apart, adjacent concrete sections. The expansion joint system includes flexible moment connections for connecting vehicle load bearing members to the support member. In certain embodiments, the expansion joint system includes flexible moment connections and friction springs. The expansion joint system may be utilized where it is desirable to absorb loads applied to the expansion joint systems, and to accommodate movements that occur in the vicinity of the expansion joint gap in response to temperature changes, seismic cycling and deflections caused by vehicular loads.

30 Claims, 5 Drawing Sheets

(56) References Cited

U.S. PATENT DOCUMENTS

| | | | | |
|---|---|---|---|---|
| 5,357,727 | A * | 10/1994 | Duckworth et al. | 52/396.06 |
| 5,365,713 | A * | 11/1994 | Nicholas et al. | 52/573.1 |
| 5,964,069 | A * | 10/1999 | Schmidt | 52/396.05 |
| 7,252,454 | B2 * | 8/2007 | Bradford et al. | 404/47 |
| 7,354,219 | B2 * | 4/2008 | Leonberg | 404/58 |
| 7,489,045 | B1 * | 2/2009 | Bradford et al. | 290/1 R |
| 7,868,475 | B1 * | 1/2011 | Bradford et al. | 290/1 R |
| 2004/0016065 | A1 | 1/2004 | Steiger et al. | |
| 2005/0262650 | A1 * | 12/2005 | Bradford et al. | 14/73.1 |
| 2008/0034692 | A1 * | 2/2008 | Helliwell et al. | 52/396.02 |
| 2008/0148499 | A1 * | 6/2008 | Bradfopd | 14/73.5 |

OTHER PUBLICATIONS

PCT/EP2011/057513—Written Opinion of the International Searching Authority, Nov. 2, 2011.

American Institue of Steel Construction, Inc., Steel Construction Manual, Thirteenth Edition, pp. 11-2 through 11-3.

Canadian Office Action for corresponding foreign application (Application No. 2,799,532)—mailing date Mar. 4, 2014, Issue Date: Jul. 16, 1957.

Chinese Office Action; issued May 20, 2014 for Patent Application No. 2011800241943, pp. 1-10.

* cited by examiner

EXPANSION JOINT SYSTEM USING FLEXIBLE MOMENT CONNECTION AND FRICTION SPRINGS

TECHNICAL FIELD

Disclosed is an expansion joint system for bridging a gap that is located between spaced-apart structural members.

BACKGROUND

An opening or gap is purposely provided between adjacent concrete structures for accommodating dimensional changes within the gap occurring as expansion and contraction due to temperature changes, shortening and creep of the concrete caused by prestressing, seismic cycling and vibration, deflections caused by live loads, and longitudinal forces caused by vehicular traffic. An expansion joint system is conventionally installed in the gap to provide a bridge across the gap and to accommodate the movements in the vicinity of the gap.

Bridge and roadway constructions are especially subject to relative movement in response to the occurrence of thermal changes, seismic events, and vehicle loads. This raises particular problems, because the movements occurring during such events are not predictable either with respect to the magnitude of the movements or with respect to the direction of the movements. In many instances bridges have become unusable for significant periods of time, due to the fact that traffic cannot travel across damaged expansion joints.

Modular expansion joint systems typically employ a plurality of spaced-apart, load bearing members or "centerbeams" extending transversely relative to the direction of vehicle traffic. The top surfaces of the load bearing members are engaged by the vehicle tires. Elastomeric seals extend between the load bearing members adjacent the tops of the load bearing members to fill the spaces between the load bearing members. These seals are flexible are therefore stretch and contract in response to movement of the load bearing members. A plurality of elongated support members are positioned below the transverse load bearing members spanning the expansion gap between the roadway sections. The support members extend longitudinally relative to the direction of the vehicle traffic. The elongated support members support the transverse load bearing members. The opposite ends of the support members are received in a housing embedded in the roadway sections.

In single support bar (SSB) modular expansion joint systems, a single support member is connected to all the transverse load bearing members. The load bearing member connection to the single support bar member commonly consists of a yoke. The yoked connection of the single support bar member to a plurality of transverse load bearing members provides a sliding or pivoting connection in the SSB modular expansion joint systems.

In a multiple support bar (MSB) modular expansion joint system, each transverse vehicular load bearing member (centerbeam) is rigidly connected to a single longitudinal support bar member. The use of yoked connections between the transverse vehicular load bearing members and the longitudinal support bar members has heretofore not been disclosed or indicated for MSB modular expansion joint systems, as MSB connections are rigid and have no need for sliding or pivoting capability.

In typical multiple support bar (MSB) expansion joint systems used in the industry, each longitudinal support bar member is welded to only one transverse vehicle load bearing member. Each transverse vehicle load bearing member is rigidly connected to its own support member by full penetration welds. While the full penetration weld connection does provide considerable structural strength and rigidity that is necessary in the rugged environment of an expansion joint, the welding poses a drawback as it is difficult to fabricate. The weld must be ultrasonically tested to pass the job specification and qualify for use. Failures of the full penetration welds used to connect a load bearing member to its own support member in MSB expansion joint systems require substantial and expensive efforts to repair the weld. In order to be adequately repaired, the weld must be severed, ground and rewelded at significant expense and time-delay.

DETAILED DESCRIPTION

Figure 1A:
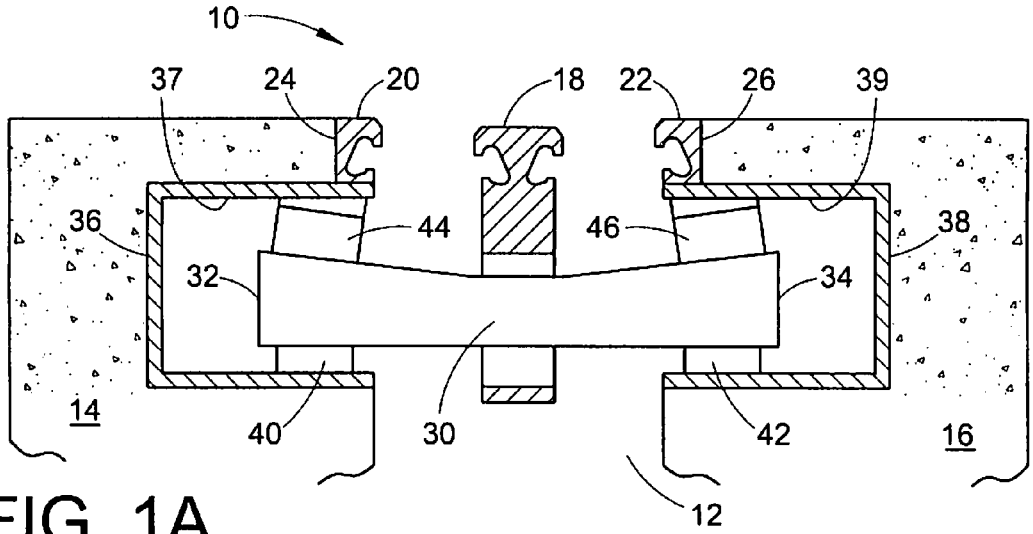
FIG. 1A is a side view of an illustrative embodiment of the expansion joint system in a fully open position with the gap being at its greatest width.

Provided is an expansion joint system located within a gap defined between adjacent first and second structural members. Without limitation, the disclosed expansion joint system may be used in small movement applications such as those of 10 inches or less. It should be appreciated, however, that the disclosed expansion joint system may be used in a wide variety of large or small movement applications.

According to certain illustrative embodiments, the expansion joint system comprises at least one vehicle load bearing member extending transverse to the direction of traffic crossing the expansion joint gap, at least one support member that is positioned below the at least one transversely extending load bearing member and extending longitudinally across the expansion joint gap, and a flexible moment connection connecting each transverse vehicular load bearing member to a single longitudinal support bar member.

According to further illustrative embodiments, the expansion joint system comprises at least one vehicle load bearing member extending transverse to the direction of traffic crossing the expansion joint gap, at least one support member that is positioned below the at least one transversely extending load bearing member and extending longitudinally across the expansion joint gap, and at least one friction spring. The cooperation of the tapered opposite longitudinal ends of the longitudinally extending support bar member with bearings together constitute the friction spring assemblies.

According to yet further illustrative embodiments, the expansion joint system comprises at least one vehicle load bearing member extending transverse to the direction of traffic crossing the expansion joint gap, at least one support member that is positioned below the at least one transversely extending load bearing member and extending longitudinally across the expansion joint gap, at least one friction spring and a flexible moment connection connecting each transverse vehicular load bearing member to a single longitudinal support bar member. The additional small amplitude vibration produced by the flexible moment connection in response to vehicular impact encourages strain energy equilibrium between opposing friction springs, leading to improved seal gap equidistance. In turn, good seal gap equidistance reduces vehicular impact to the centerbeams. The synergy between the flexible moment connection and the friction springs provides for an effective embodiment of the system.

According to further illustrative embodiments, the expansion joint system comprises at least one vehicle load bearing member extending transverse to the direction of traffic crossing the expansion joint gap, a plurality of support members that are positioned below the at least one transversely extending load bearing member and extending longitudinally across the expansion joint gap, the plurality of support members comprise outer support members and at least one inner support member positioned between the outer support members, friction springs and non-friction springs. The tapered opposite longitudinal ends of the outer support bar members cooperate with bearings to constitute friction springs, while opposite ends of the one or more inner support bar members cooperate with standard elastomeric springs.

According to further illustrative embodiments, the expansion joint system comprises at least one vehicle load bearing member extending transverse to the direction of traffic crossing the expansion joint gap, at least one support member that is positioned below the at least one transversely extending load bearing member and extending longitudinally across the expansion joint gap, and friction spring assemblies. The friction spring assemblies comprise the tapered opposite ends of the longitudinally extending support bar members in cooperation with bearings having different spring rates. The opposite tapered ends of the support bar members are located within housings embedded within spaced-apart structural members. The bearings are positioned within a space between the upper surfaces of the tapered ends of the support bar members and the upper wall of the housings. The first opposite tapered end of the support bar member cooperates with a bearing having a first spring rate and the second opposite tapered end of the support bar member cooperates with a bearing having a second spring rate that is different from the first spring rate.

The expansion joint system comprises at least one transversely extending vehicular load bearing member having top surfaces that are exposed to traffic and bottom surfaces opposite from the top surfaces. The expansion joint system includes at least one support member positioned below the at least one transversely extending load bearing member and extending longitudinally across the expansion joint from the first structure to the second structure, and wherein the at least one support member comprises at least one angled or tapered surface.

The flexible moment connection connecting the transversely extending vehicular load bearing member to the support member may comprise a yoke assembly. According to certain embodiments, the yoke assembly is in fixed engagement with the load bearing member for connecting the load bearing member to the support member. The yoke assembly may be integrally connected to the vehicle load bearing member. Alternatively, the yoke assembly may be mechanically attached to the one load bearing member by a mechanical fastener or a suitable weld. Without limitation, and only by way of illustration, the yoke assembly may comprise a substantially U-shaped cross-section yoke.

The yoke assembly carries a spring that resiliently urges the support member toward the load bearing member. The spring is positioned at the saddle portion of the substantially U-shaped yoke and engages the lower surface of the longitudinal support bar member. A seating member may also be positioned between the load bearing member and the support member to serve as a seating for the load bearing member. The seating member may comprise an elastomeric material. Without limitation, the elastomeric material may selected from polyurethane, polychloroprene, isoprene, styrene butadiene rubber, natural rubber and combinations of these elastomeric materials. According to certain embodiments, the elastomeric material used to manufacture the seating member comprises a urethane material. In operation, the load bearing member resiliently engages the support member and the seating member permits the load bearing member a small amount of movement to allow for alignment of said load bearing member relative to said support member. The small amount of elastic flexibility substantially eliminates the permanent damage (yielding) that occurs in rigid connection joints during shipping, handling, and installation.

The flexible moment connection may be fixedly disposed on a bottom surface of the vehicle load bearing members, yet the flexible moment connection allows the load bearing member to translate and rotate elastically relative to the support member helping to absorb vehicle impact. The vibratory response encourages seal gap equalizing movement in the so called "stagnation zone" of the friction springs. Moreover, while yoke assembly allows the load bearing member to translate and rotate elastically relative to the support member it prevents the load bearing member from sliding into a completely new position.

The opposite ends of the longitudinally extending support members are located in housings that are embedded in the spaced-apart structural members. The housings are provided to accommodate the longitudinal and pivoting movement of the support bar members and to accommodate decreasing gap width.

Without limitation, the first and second housings for accepting the ends of the elongated support members extending longitudinally across said gap may comprise a box-like receptacle. It should be noted, however, that the housings for accepting the ends of the support bar members may include any structure such as, for example, receptacles, chambers, containers, enclosures, channels, tracks, slots, grooves or passages, that includes a suitable cavity for accepting the opposite end portions of the support bar members.

The expansion joint system may also include flexible and compressible seals extending between the load bearing member and edge members that are engaged with first and second structural members. According to embodiments of the expansion joint system that employ more than one transverse vehicle load bearing member, the system may include flexible and compressible seals extending between the load bearing members and between the load bearing members and the edge members of the system. Useful seals include, without limitation, strip seals, glandular seals, and membrane seals.

A flexible moment connection is provided, the flexible moment connection connecting a load bearing member to a support member positioned beneath the load bearing member, said flexible moment connection comprising a yoke assembly in fixed engagement with the load bearing member for connecting the load bearing member to the support member and spring means carried by the yoke assembly resiliently urging the support member toward the load bearing member, but preventing sliding.

According to certain embodiments, a seating member is interposed between the load bearing member and the support member to serve as a seating for the load bearing member, the seating member being formed of elastomeric material, the load bearing member resiliently engaging the support member whereby the seating member permits the load bearing member a small amount of movement to allow for alignment of the load bearing member relative to the support member.

An expansion joint system is further provided for a roadway construction wherein a gap is defined between adjacent first and second roadway sections, said expansion joint system extending across said gap to permit vehicular traffic, said expansion joint system comprising transversely extending, spaced-apart, vehicular load bearing members having top surfaces exposed to traffic and bottom surfaces opposite said top surfaces elongated support members having opposite ends positioned below said transversely extending load bearing members and extending longitudinally across the expansion joint from the first roadway section to the second roadway section, and at least one flexible moment connection fixedly disposed on a bottom surface of one of the load bearing members, the flexible moment connection connecting the load bearing member with only one of the support members to allow the load bearing member to translate and rotate elastically, but not slide relative to the support member.

In another embodiment, an expansion joint system is provided for a roadway construction wherein a gap is defined between adjacent first and second roadway sections, the expansion joint system extending across the gap to permit vehicular traffic, the expansion joint system comprising transversely extending, spaced-apart, vehicular load bearing members having top surfaces exposed to traffic and bottom surfaces opposite the top surfaces, elongated support members having opposite ends positioned below the transversely extending load bearing members and extending longitudinally across the expansion joint from the first roadway section to the second roadway section; and at least one flexible moment connection connecting one of the load bearing members with only one of the support members, the flexible moment connection comprising a yoke assembly in fixed engagement with the load bearing member, and spring means carried by the yoke assembly resiliently urging the support member toward the load bearing member, wherein the yoke assembly allows the load bearing member to translate and rotate elastically relative to the support member but not to slide to a new position.

Without limitation, the flexible moment connection can be utilized in connection with a multiple support bar expansion joint system in roadway constructions, bridge constructions, tunnel constructions, and other constructions where gaps are formed between spaced-apart, adjacent concrete sections. The expansion joint system including a flexible moment connection may be utilized where it is desirable to absorb loads applied to the expansion joint systems, and to accommodate movements that occur in the vicinity of the expansion joint gap in response to the application of the applied loads to the expansion joint system.

Flexible moment connections provide a simple, reliable and economical alternative in the design of connections that must resist lateral-load-induced moments. Flexible moment connections have been used in the design of steel structures, but their design and usage is markedly different than that proposed for use in MSB expansion joint systems. In addition to design and usage differences, the level of flexibility afforded by the expansion joint system is orders of magnitude higher than steel connections.

The flexible moment connection maintains the position of a support member relative to a bottom surface of a load bearing beams member. Also, the flexible moment connection comprises a fixed yoke that does not slide or move relative to the load bearing member. However, there is a slight flexibility or elasticity built into the fixed yoke connection, which allows the load bearing member to translate and rotate elastically relative to the support member, but not to slide to a new position. Unlike single support bar expansion joint systems, the support member does not slide through the yoke. The yoke assembly of the flexible moment connection does not permit moveable or slidable engagement of the load bearing member and the support member. The flexible moment connection distributes the moments and stresses more evenly throughout the connection so that a fixed but resilient connection is achieved.

Figure 1B:
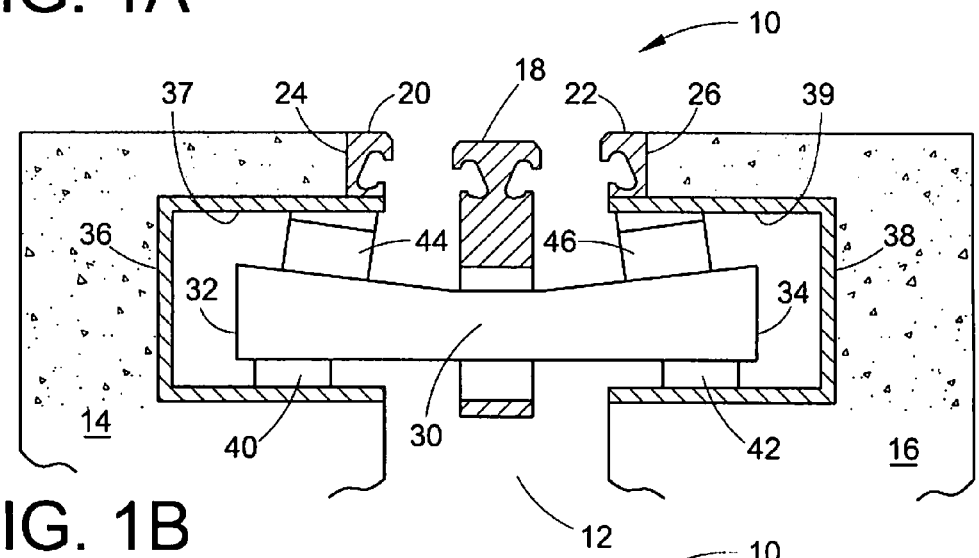
FIG. 1B is a side view of an illustrative embodiment of the expansion joint system shown in FIG. 1A at the mid-position between full opening and full closure.
Figure 1C:
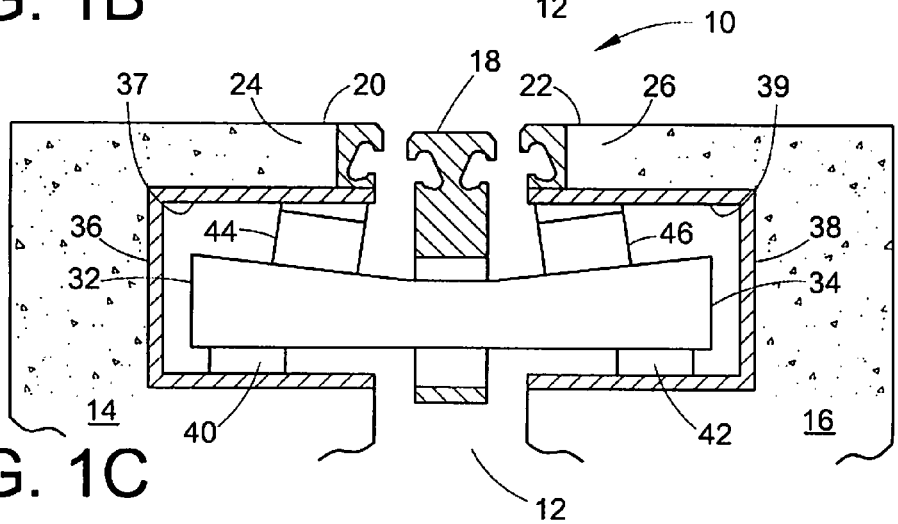
FIG. 1C is a side view of an illustrative embodiment of the expansion joint system of FIG. 1A in a fully closed position with the gap being at its smallest width.

FIGS. 1A-1C shows an illustrative embodiment of the expansion joint system 10 located in a gap 12 between two spaced-apart sections of roadway 14, 16. In the illustrative embodiment shown in FIGS. 1A-1C, the expansion joint system 10 includes one vehicle load bearing member 18 that extends transversely in the gap 12 in relation to the direction of the flow of vehicular traffic across the expansion joint system 10 and gap 12. While the illustrative embodiment shown in FIGS. 1A-1C shows a single transversely extending load bearing member 18, it should be noted that any number of such transversely extending vehicular load bearing members may be used in the expansion joint system depending on the size of the gap and the movement desired to be accommodated. When there are more than one transversely extending vehicular load bearing members used in the expansion joint system, the plurality of the transversely extending vehicular load members, the beam members are generally positioned in a side-by-side relationship and extend transversely in the expansion joint relative to the direction of vehicle travel. The top surface(s) of the vehicular load bearing members 18 are adapted to support vehicle tires as a vehicle passes over the expansion joint.

According to certain embodiments, the vehicular load bearing member 18 has a generally square or rectangular cross-section. It should be noted, however, that the load bearing member(s) are not limited to members having approximately square or rectangular cross sections, but, rather, the load bearing members may comprise any number of cross sectional configurations or shapes. The shape of the cross section of load bearing members is only limited in that the shape of the load bearing members must be capable of providing relatively smooth and unimpeded vehicular traffic across the top surfaces of the load bearing members.

Still referring to FIGS. 1A-1C, expansion joint system 10 includes edge beams or members 20, 22. Edge members 20, 22 are located adjacent edge face surfaces 24, 26 of structure members 14, 16.

Still referring to FIGS. 1A-1C, the expansion joint system 10 includes support bar member 30. Elongated support bar member 30 extends longitudinally within the expansion joint gap 12, that is, the support bar member 30 extends substantially parallel relative to the direction of vehicle travel across the expansion joint system 10 and gap 12. The support bar member 30 provides support for the vehicle load bearing member 18 as vehicular traffic passes over the expansion joint system 10 and gap 12. Elongated support bar member 30 includes opposite ends 32, 34. Each opposite end 32, 34 end of the support bar member 30 is located in a suitable housing 36, 38 for accepting the ends 32, 34 of the support bar member 30. As discussed in greater detail herein, the housings 36, 38 for accepting the ends 32, 34 of the support bar member 30 is disposed, or embedded in the "block-out" (14*a*, 16*a*) regions of respective adjacent roadway sections in the roadway construction. The expansion joint system 10 can be affixed within the block-out areas between two roadway sections by disposing the system into the gap between the roadway sections and introducing concrete into the block-out regions or by mechanically affixing the expansion joint system in the gap to underlying structural support. Mechanical attachment may be accomplished, for example, by bolting or welding the expansion joint system to the underlying structural support.

The expansion joint system 10 includes lower bearings 40, 42 that are positioned between bottom surfaces of support bar member 30 and the upper surfaces of the bottom walls of housings 36, 38. The upper surfaces of the lower bearings 40, 42 provide sliding surfaces for the lower surface of the support bar member 30. Expansion joint system 10 also includes upper bearings 44, 46 that are positioned between the upper surface of the support bar member 30 and surfaces of the upper walls of housing 37, 39. The lower surfaces of the upper bearings 44, 46 provide sliding surfaces for the upper surface of supper bar member 30.

The support bar member 30 includes angled or otherwise tapered end regions 32, 34. The tapered regions 32, 34 of the support bar member 30 and bearings 44, 46 together constitute friction springs. These friction springs combine the restoring force and support bar member bearing functions through the use of the angled regions. Without being bound to any particular theory, the friction springs work by altering bearing precompression as the expansion joint gap is opened and closed. As the expansion joint gap is opened, the tapered ends 32, 34 of the support bar force the bearings to increase bearing precompression, thereby inducing larger horizontal forces. The increased friction force helps stabilize the expansion joint system against horizontal vehicular impacts, while the increased restoring (spring) force helps maintain equidistance between the vehicular load bearing members and between the vehicular load baring members and edge members of the expansion joint system.

Through the use of the tapered support bar member 30, a spring force is produced because the precompression in the upper bearings 44, 46 are disposed at an angle relative to the support bar member 30. As the support bar member 30 changes position relative to the upper bearings, the precompression changes and the force in the direction of the support bar member 30 changes. As the support bar member 30 changes position the restoring force changes proportionately, similar to a linear spring. As the precompression increases upon opening of the expansion joint gap, the joint friction increases as well, thereby providing higher lateral resistance to larger joint openings. These properties culminate to provide an expansion joint system that resists higher lateral impact loads. Thus, the expansion joint system can provide equidistance between the transverse vehicular load bearing members and between the vehicular load bearing members and edge members without the use of separate spring components.

Figure 2A:
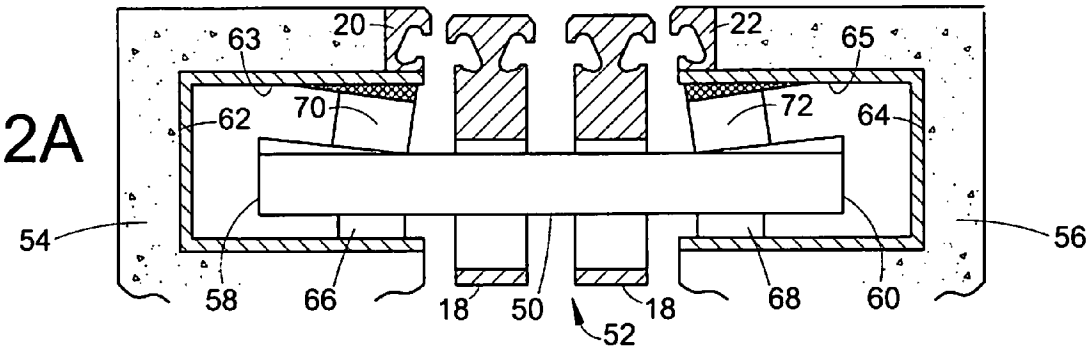
FIG. 2A is a side view of another illustrative embodiment of the expansion joint system in a fully closed position with the gap being at its greatest width.
Figure 2B:
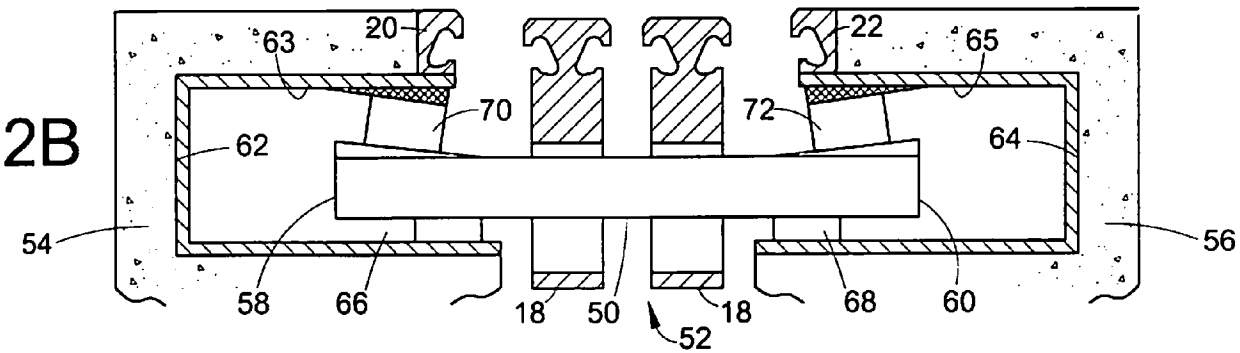
FIG. 2B is a side view of the illustrative embodiment of the expansion joint system shown in FIG. 2A at the mid-position between full opening and full closure.
Figure 2C:
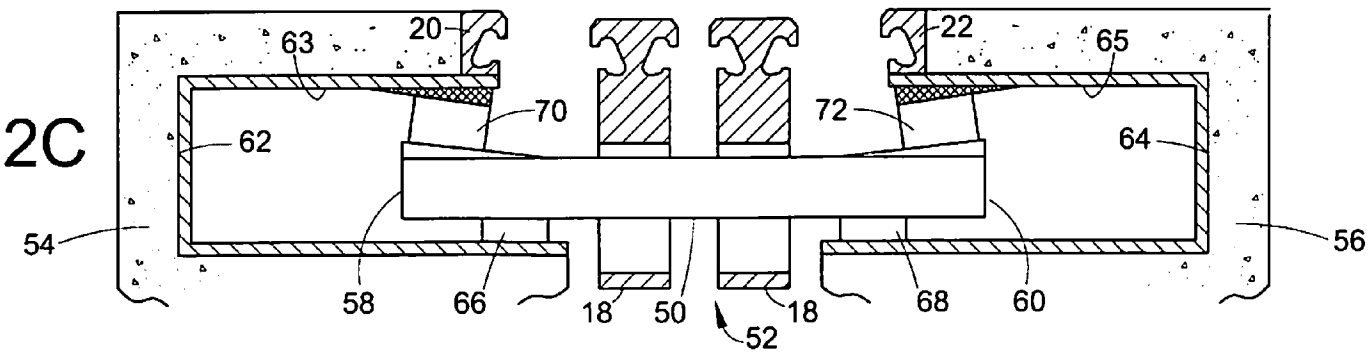
FIG. 2C is a side view of the illustrative embodiment of the expansion joint system of FIG. 2A in a fully open position with the gap being at its smallest width.

According to the illustrative embodiment shown in FIGS. 2A-2C, there are two spaced-apart vehicular load bearing members 18 positioned within the gap. Elongated support bar member 50 extends longitudinally within the expansion joint gap 52 located between spaced-apart roadway sections 54, 56. The support bar member 50 provides support for the vehicle load bearing member as vehicular traffic passes over the expansion joint gap 52. Elongated support bar member 50 includes opposite ends 58, 60. Each opposite end 58, 60 end of the support bar member 50 is located in a suitable housing 62, 64 for accepting the ends 58, 60 of the support bar member 50. The housings 62, 64 for accepting the ends 58, 60 of the support bar member 50 is disposed, or embedded in the "block-out" regions of respective adjacent roadway sections in the roadway construction. The tapered end regions 58, 60 of support bar member 50 may be provided with different angles. Because of the different angles of the tapers of the tapered end regions 58, 60 of the support bar member 50, different spring rates are produced. By way of example, and not in limitation, the support bar member 50 of the expansion joint system may be provided with tapered angles wherein a first tapered angle 58 produces a first spring rate and a second tapered angle 60 produces a spring rate that is about one half of the spring rate produced by the first tapered angle 58. Accordingly, the end of the support bar member 50 with the tapered angle 58 producing the lower spring rate will move about twice as much as the end 60 of the support bar member 50 producing the higher spring rate.

Still referring to FIGS. 2A-2C, the expansion joint system includes lower bearings 66, 68 that are positioned between bottom surfaces of support bar member 50 and the upper surfaces of the bottom walls of housings 62, 64. The upper surfaces of the lower bearings 66, 68 provide sliding surfaces for the lower surface of the support bar member 50. Expansion joint system also includes upper bearings 70, 72 that are positioned between the upper surface of the support bar member 50 and surfaces of the upper walls 63, 65 of housing 62, 64. The lower surfaces of the upper bearings 70, 72 provide sliding surfaces for the upper surface of supper bar member 50.

Figure 3A:
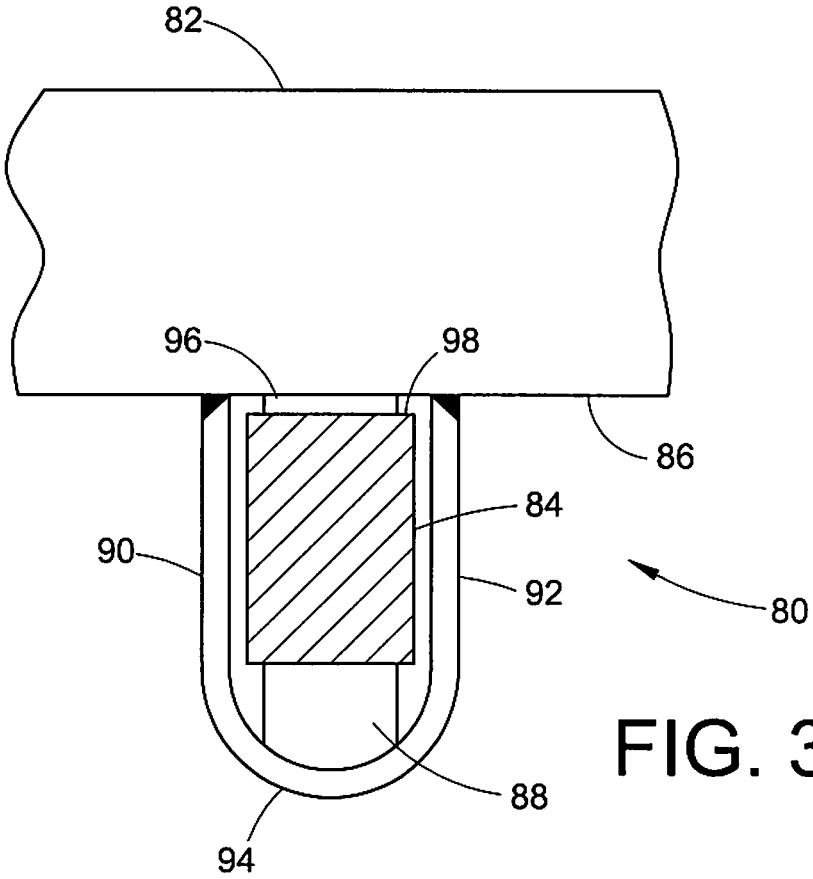
FIG. 3A is a side view of an illustrative embodiment of the flexible moment connection connected to a vehicular load bearing member.

According to other embodiments, the expansion joint system may include a flexible moment connection for connecting the support bar members to the vehicular load bearing members. The flexible moment connection may employ a fixed, yet elastically flexible yoke assembly. The flexible moment connection of the expansion joint system will now be described in greater detail with reference to FIGS. 3A-3B. It should be noted that the flexible moment connection is not intended to be limited to the illustrative embodiments shown in these FIGS. Referring now to FIGS. 3A-3B, the flexible moment connection 80 connects a load bearing member 82 to a support bar member 84 that is positioned below the load bearing member 82. The flexible moment connection 80 comprises a yoke assembly that is in fixed engagement with a bottom surface 86 of the load bearing member 82 for connecting the load bearing member 82 to the support bar member 84.

Without limitation, the yoke assembly 80 is integrally formed as a unitary piece with the load bearing member 82. An integrally formed flexible moment connection eliminates the need for additional components and facilitates manufacture and assembly. Alternatively, the yoke assembly 80 may be a separate component that is mechanically connected to the bottom surface of the load bearing member 82. For example, the yoke assembly 80 may be connected to the load bearing member 82 by mechanical fasteners 100, 102, by welding, or by any other suitable means known in the art. Spring means 88 carried by the yoke assembly 80 resiliently urge the support member 84 toward the load bearing member 82.

Without limitation, the yoke assembly 80 may comprise a U-shaped in cross-section and includes a pair of parallel arms 90, 92 spaced by a curved spanning section (or cross member) 94 spanning the gap between the arms 90, 92. The curved spanning section 94 may also be referred to as the "saddle" region of the yoke assembly 80. While the yoke assembly 80 may be U-shaped, other configurations are presently contemplated, such as where the arms may be generally perpendicular to the spanning section. When a U-shaped yoke assembly is used in the expansion joint system, the spring means 88 is positioned in the saddle region 94 of the yoke assembly 80.

The load bearing member 82 is seated on a flat seating member 96 within the yoke assembly 80 interposed between the load bearing member 82 and the support member 84. The seating member 96 rests on the upper surface 98 of the support member 84. The seating member 96 may be centrally located on the support member 84 and may be fixed to the support member 84 by means of one or more dowels, not shown. It should be appreciated that the seating member 96 can be attached to the support member 84 by any suitable means, such as by welding, fastening, frictionally engaging or by any other suitable mechanism. As shown, the seating member 96 is rectangular in shape, however, any shape. The load bearing member 82 resiliently engages the support member 84 whereby the seating member 96 permits the load bearing member 82 a small amount of movement to allow for alignment of the load bearing member 82 relative to the support member 84.

The compression spring 88 is located the spanning section 94 of the yoke assembly 80, whereby the support member 80 is normally urged into contact with the load bearing member 82. The support member 84 rides between the seating member 96 and the spring 88, which acts to dampen the dynamic loading. The spring 88 holds the support member 84 in place and mitigates looseness, rattling and uplifting. The low stiffness and high damping properties of the spring serves to reduce the impact force from traffic loading, mitigate vibration when large vehicular loads are applied and prevent noise caused by metallic contact. The spring is precompressed to fit into the yoke 84 and prevent gapping in the connection during vehicular loading. The compression spring 88 may be comprised of a commercially available polyurethane. The spring 88 provides a degree of flexibility to the flexible moment connection 80. Thus, each load bearing member 82 of the expansion joint system is fixed to its own support member 84 by the flexible moment connection yoke assembly 80 which provides some elastic flexibility. The fixed yoke assembly 80 of the flexible moment connection prevents the support member 84 from moving longitudinally or prevents sliding to a new position relative to the load bearing member in response to expansion and contraction of the roadway and other movements. However, the spring means 88 in conjunction with the elastomeric seating member 96 in the yoke assembly 80 allows the load bearing member 82 to rotate elastically relative to the support bar 84.

Figure 3B:
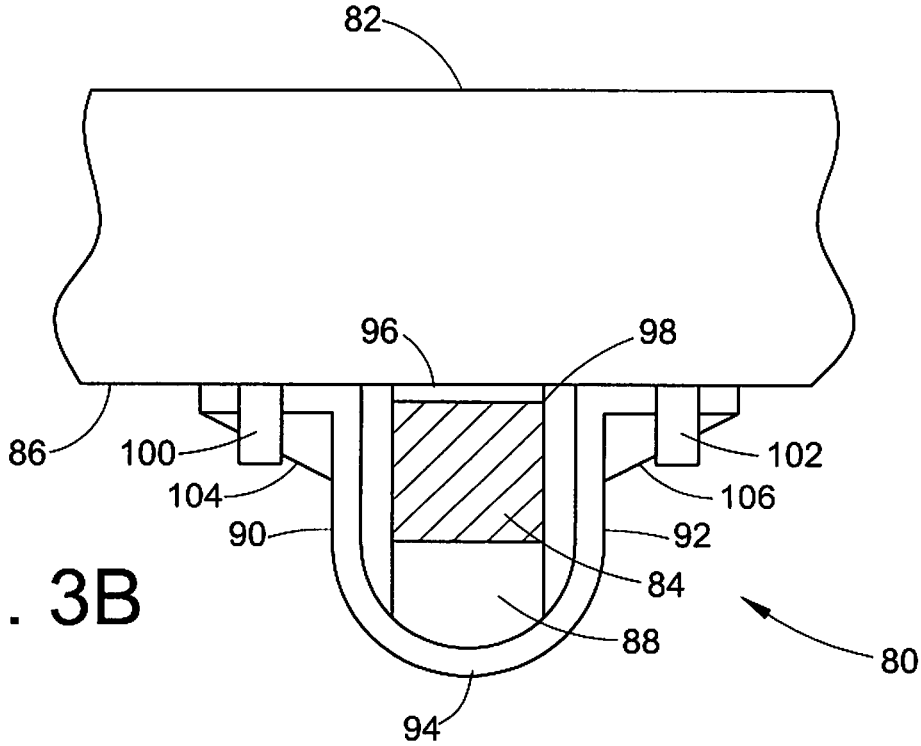
FIG. 3B is a side view of another illustrative embodiment of the flexible moment connection connected to a vehicular load bearing member.

As shown in FIG. 3B, the flexible moment connection 80 may be affixed to the load bearing member 82 by passing mechanical fasteners 100, 102 through holes provided in flange portions 104, 106 of the connection 80.

Figure 4:
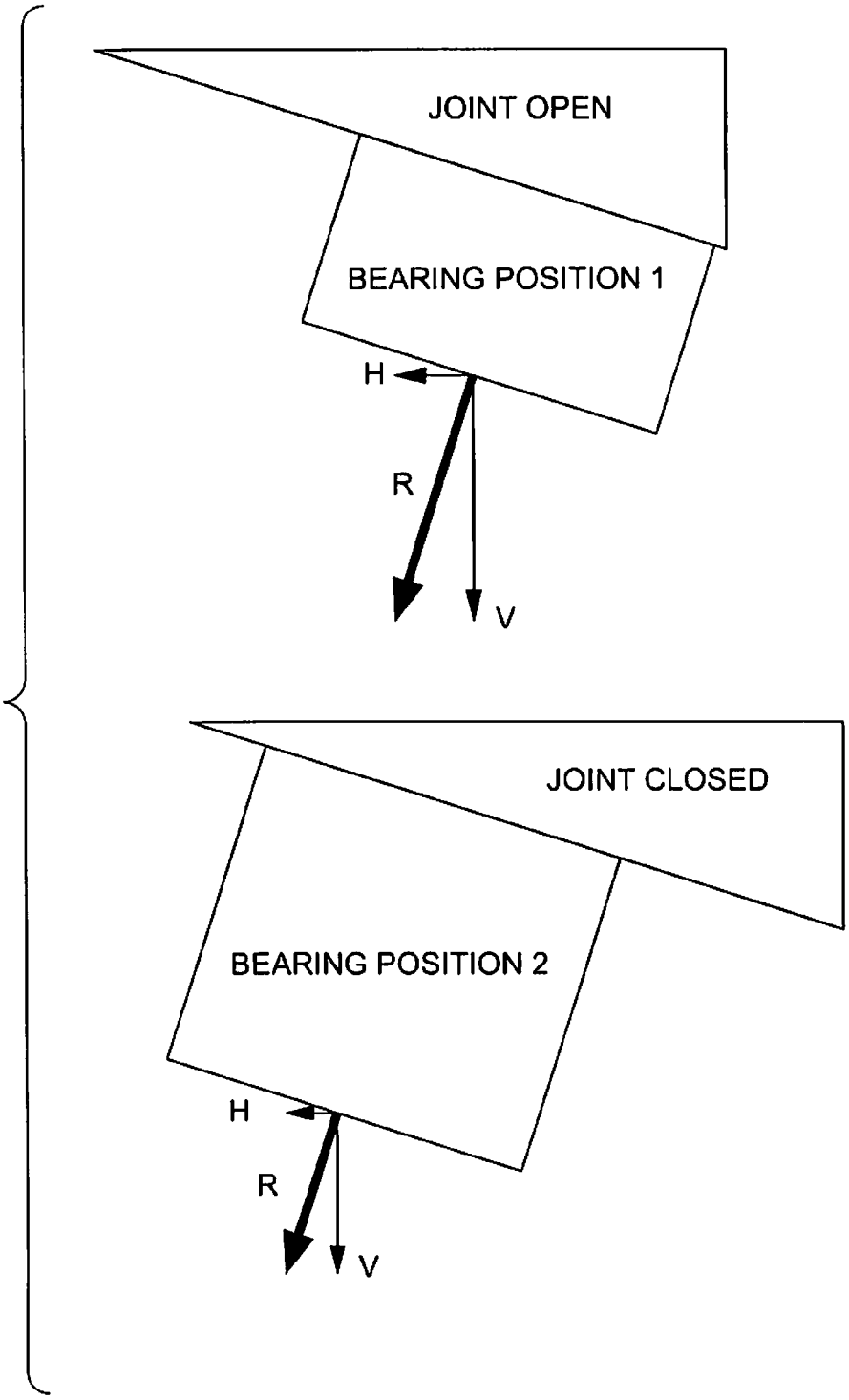
FIG. 4 is a free body diagram depicting the forces exerted by the bearings in contact with the longitudinal support bar members of the expansion joint system.
Figure 5:
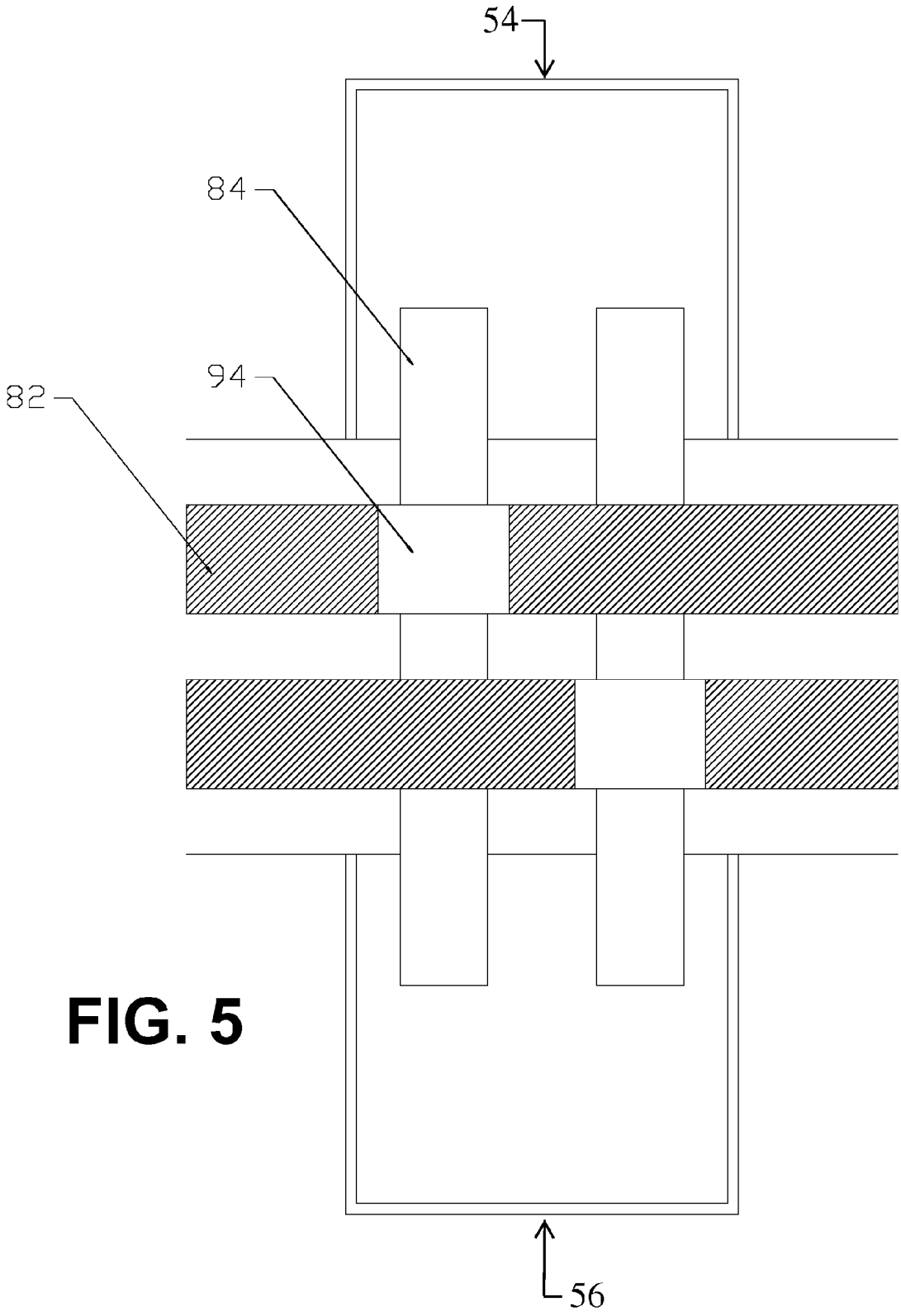
FIG. 5 is a bottom plan view of an illustrative embodiment of the expansion joint system.

FIG. 4 shows two free body diagrams depicting the forces exerted by bearings in that are contact with the tapered ends of the longitudinally extending support bar members of the expansion joint system and which have different levels of compression. As shown in FIG. 4, vector arrow R represents the spring force exerted by the bearing on the tapered end of the longitudinally extending support bar member, vector arrow H represents the horizontal component of the spring force exerted by the bearing on the tapered end of the longitudinally extending support bar member, and vector arrow V represents the vertical component of the spring force exerted by the bearing on the tapered end of the longitudinally extending support bar member. According to the free body diagram of FIG. 4, it is shown that the bearing having an increased compression results in an increase the horizontal component of the spring force on the tapered end of the longitudinally extending support bar member.

Accordingly, the friction springs are designed to provide the restoring force function with the use of separate spring components. The design eliminates springs, reduces fabrication time and cost, reduces design complexity, facilitates joint assembly. Elastomeric spring components on standard modular joints are the component that fails most often, use of friction springs will eliminate this failure mode, and hence reduce maintenance costs.

Accordingly, the flexible moment connection is designed to increase fatigue life by eliminating the fatigue sensitive rigid connection weld detail, impact resistance by filtering out stress waves, increase vehicular impact vibration characteristics, and provide a tighter, more stable load bearing member/support bar connection. Use of the flexible moment connection of the invention results in a significant reduction in connection costs, which are a large part of fabrication or labor costs. Additionally, the flexible moment connection of the invention provides in-situ connection replaceability capability.

The expansion joint system may be used in the gap between adjacent concrete roadway sections. The concrete is typically poured into the blockout portions of adjacent roadway sections. The gap is provided between first and second roadway sections to accommodate expansion and contraction due to thermal fluctuations and seismic cycling. The expansion joint system can be affixed within the block-out portions between two roadway sections by disposing the system into the gap between the roadway sections and pouring concrete into the block-out portions or by mechanically affixing the expansion joint system in the gap to underlying structural support. Mechanical attachment may be accomplished, for example, by bolting or welding the expansion joint system to the underlying structural support.

It is thus demonstrated that the present invention provides a flexible moment connection that can be utilized in connection with an expansion joint system in roadway constructions, bridge constructions, tunnel constructions, and other constructions where gaps are formed between spaced-apart, adjacent concrete sections. The expansion joint system including a flexible moment connection may be utilized where it is desirable to absorb loads applied to the expansion joint systems, and to accommodate movements that occur in the vicinity of the expansion joint gap in response to temperature changes, seismic cycling and deflections caused by vehicular loads.

The flexible moment connection provides an improved connection that is strong and reliable, and a multiple support bar modular expansion joint system including an improved connection that can be used instead of the difficult-to-fabricate and failure-prone full penetration weld, to fixedly connect each load bearing member of the expansion joint to its own support member. The expansion joint system including the improved connection is able to accommodate large movements that occur separately or simultaneously in multiple directions in the vicinity of a gap having an expansion joint between two adjacent roadway sections, for example, movements occurring in longitudinal and transverse directions relative to the flow of traffic, and which are a result of thermal changes, prestressing, seismic events, and vehicular load deflections.

While the expansion joint system has been described above in connection with the certain illustrative embodiments, as shown in the various Figures, it is to be understood that other similar embodiments may be used or modifications and additions may be made to the described embodiments for performing the same function of the expansion joint system without deviating therefrom. Further, all embodiments disclosed are not necessarily in the alternative, as various embodiments may be combined to provide the desired characteristics. Variations can be made by one having ordinary skill in the art without departing from the spirit and scope of the disclosure.

The invention claimed is:

1. An expansion joint system for a gap defined between adjacent first and second structures comprising:

a plurality of transversely extending vehicular load bearing members having top surfaces exposed to traffic and bottom surfaces opposite said top surfaces;

a plurality of support members positioned below said transversely extending load bearing members and extending longitudinally across said gap from said first structure to said second structure; and a flexible moment connection connecting each one of said transversely extending vehicular load bearing members to only one support member, wherein said flexible moment connection does not permit said transversely extending vehicular load bearing members to slide relative to said support member to a new position.

2. The expansion joint system of claim 1, wherein said flexible moment connection comprises:

a yoke assembly in fixed engagement with the load bearing member for connecting the load bearing member to the support member; and spring means carried by the yoke assembly urging the support member toward the load bearing member.

3. The expansion joint of claim 2, wherein said yoke assembly comprises a substantially U-shaped cross-section.

4. The expansion joint system of claim 2, wherein said yoke assembly is mechanically attached to one of said at least one load bearing member.

5. The expansion joint system of claim 4, wherein said mechanical attachment comprises a mechanical fastener.

6. The expansion joint system of claim 4, wherein said mechanical attachment comprises a weld.

7. The expansion system of claim 2, wherein a seating member is interposed between the load bearing member and the support member to serve as a seating for the load bearing member.

8. The expansion joint system of claim 2, wherein said load bearing member resiliently engages the support member and said seating member permits said load bearing member a small amount of movement to allow for alignment of said load bearing member relative to said support member.

9. The expansion joint system of claim 7, wherein said seating member comprises an elastomeric material.

10. The expansion joint of claim 9, wherein said elastomeric material is selected from the group consisting of polyurethane, polychloroprene, isoprene, styrene butadiene rubber, natural rubber and combinations thereof.

11. The expansion joint of claim 10, wherein said elastomeric material comprises a urethane material.

12. The expansion joint system of claim 2, wherein said at least one flexible moment connection is fixedly disposed on a bottom surface of each of said load bearing members.

13. The expansion joint system of claim 2, wherein said yoke assembly allows the load bearing member to rotate elastically relative to the support member but not to slide to a new position.

14. The expansion joint system of claim 13, further comprising first and second means for accepting the opposite ends of said support members.

15. The expansion joint system of claim 14, wherein said at least one support member comprising at least one tapered end.

16. The expansion joint system of claim 15, wherein said at least one support member comprises two tapered ends.

17. The expansion joint system of claim 16, further comprising bearings positioned between the upper surfaces of said tapered support members and said first and second means for accepting said opposite ends of said support members.

18. The expansion joint system of claim 17, wherein said two tapered ends of said at least one support member comprises different taper angles.

19. The expansion joint system of claim 17, wherein said two tapered ends of said at least one support member produce substantially the same spring rate.

20. The expansion joint system of claim 17, wherein said two tapered ends of said at least one support member produce different spring rate.

21. The expansion joint system of claim 14, wherein said first and second means for accepting the ends of said support members are structures selected from the group consisting of boxes, receptacles, chambers, housings, containers, enclosures, channels, tracks, slots, grooves and passages.

22. The expansion joint system of claim 21, comprising flexible and compressible seals extending between at least two of said load bearing members, and between said load bearing members and edge sections of said first and said second structures.

23. The expansion joint system of claim 22, wherein said seals are selected from strip seals, glandular seals, and membrane seals.

24. An expansion joint system for a gap defined between adjacent first and second structures comprising:

at least one transversely extending vehicular load bearing member having top surfaces exposed to traffic and bottom surfaces opposite said top surfaces;

at least one support member positioned below said at least one transversely extending load bearing member and extending longitudinally across said expansion joint from said first structure to said second structure, wherein said at least one support member comprises tapered ends;

means for accepting the opposite ends of said support members; and bearings positioned between the upper surfaces of said tapered ends of said support members and said means for accepting said opposite ends of said support members.

25. The expansion joint system of claim 24, wherein said tapered ends of said at least one support member comprises different taper angles.

26. The expansion joint system of claim 25, wherein said tapered ends of said at least one support member produce substantially the same spring rate.

27. The expansion joint system of claim 25, wherein said tapered ends of said at least one support member produce different spring rate.

28. The expansion joint system of claim 24, wherein said means for accepting the ends of said support members are structures selected from the group consisting of boxes, receptacles, chambers, housings, containers, enclosures, channels, tracks, slots, grooves and passages.

29. An expansion joint system for a gap defined between adjacent first and second structures comprising:

a plurality of transversely extending vehicular load bearing members having top surfaces exposed to traffic and bottom surfaces opposite said top surfaces;

a plurality of support members positioned below said transversely extending load bearing members and extending longitudinally across said gap from said first structure to said second structure; and a flexible moment connection fixedly connecting each one of said transversely extending vehicular load bearing members to only one support member, wherein said flexible moment connection does not permit said transversely extending vehicular load bearing members to slide relative to said support member to a new position.

30. The expansion joint system of claim 24, wherein said tapered ends of said at least one support member comprise the same taper angles.

* * * * *